US008948655B2

(12) United States Patent
Sato

(10) Patent No.: US 8,948,655 B2
(45) Date of Patent: Feb. 3, 2015

(54) IMAGE FORMING APPARATUS

(71) Applicants: Kabushiki Kaisha Toshiba, Tokyo (JP); Toshiba Tec Kabushiki Kaisha, Tokyo (JP)

(72) Inventor: Tsutomu Sato, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/074,793

(22) Filed: Nov. 8, 2013

(65) Prior Publication Data

US 2014/0126931 A1 May 8, 2014

(30) Foreign Application Priority Data

Nov. 8, 2012 (JP) ..... 2012-246736

(51) Int. Cl.
*G03G 21/00* (2006.01)
*G03G 21/16* (2006.01)
*G03G 15/01* (2006.01)

(52) U.S. Cl.
CPC ..... *G03G 21/168* (2013.01); *G03G 21/1647* (2013.01); *G03G 15/0189* (2013.01); *G03G 2215/0132* (2013.01); *G03G 2215/0193* (2013.01)
USPC ..... 399/121

(58) Field of Classification Search
USPC ..... 399/121
See application file for complete search history.

(56) References Cited

U.S. PATENT DOCUMENTS

| | | | | |
|---|---|---|---|---|
| 2010/0080625 | A1* | 4/2010 | Furuya et al. | 399/121 |
| 2013/0064572 | A1* | 3/2013 | Shiba et al. | 399/121 |
| 2013/0223879 | A1* | 8/2013 | Onodera et al. | 399/121 |
| 2014/0126931 | A1* | 5/2014 | Sato | 399/121 |
| 2014/0186073 | A1* | 7/2014 | Ju et al. | 399/121 |

* cited by examiner

*Primary Examiner* — Wib Perkey
(74) *Attorney, Agent, or Firm* — Patterson & Sheridan LLP.

(57) ABSTRACT

An image forming apparatus according to an embodiment includes: a separating mechanism configured to move a transfer belt between a first position in which the transfer belt contacts a photoconductor to a second position, a separating shaft configured to rotate to cause the separating mechanism to move from the first position to the second position. The image forming apparatus further includes a lever configured to be removably mounted on a first end of the separating shaft, and an accommodation section configured to accommodate the lever in a body of the image forming apparatus. A second end of the separating shaft prevents the accommodation of the lever in the accommodation section when the lever is removed and when the separating shaft is in the first rotation position.

20 Claims, 10 Drawing Sheets

DIAGRAM VIEWED FROM ARROW DIRECTION OF E (a)

(b)

IMAGE FORMING APPARATUS

CROSS-REFERENCE TO RELATED APPLICATION

This application is based upon and claims the benefit of priority from Japanese Patent Application No. 2012-246736, filed Nov. 8, 2012, the entire contents of which are incorporated herein by reference.

FIELD

Embodiments described herein relate to a lever structure of a transfer belt separating mechanism, that is capable of keeping the transfer belt separated from a processing unit and closing a cover during factory shipment of an image forming apparatus.

BACKGROUND

Conventionally, in an image forming apparatus such as a Multi Function Peripheral (MFP), a circulating transfer belt is brought into pressure contact with photoconductive drums of Y (Yellow), M (Magenta), C (Cyan) and K (Black) processing units through a transfer roller. Accordingly, a toner image on each photoconductive drum can be transferred to the transfer belt.

When the processing units are detached from the main body of the image forming apparatus, a transfer belt separating mechanism is operated to move each transfer roller arranged opposite to each photoconductive drum away from the transfer belt, thereby separating the transfer belt from the photoconductive drums.

The transfer belt separating mechanism is operated as follows: a front cover arranged on the front side of the main body of the image forming apparatus is opened, a separating lever folded and accommodated at a specific position of the main body of the image forming apparatus is pulled down to a near side to be gripped, and a gripping section of the separating lever is twisted in a given direction. When the separating lever is pulled down to the near side of an operator, the front cover cannot be closed because the separating lever interferes with the front cover. A cover opening and closing detection switch detects that the cover is opened, which prevents the image forming apparatus from operating even if a start switch is accidentally pressed.

The separating lever is twisted in a direction opposite to the direction in which the separating lever is twisted for separation, so that the transfer belt is brought into press contact with each photoconductive drum. Then, the separating lever is folded and accommodated at the original specific position to close the front cover completely, and the opening and closing detection switch detects that the cover is closed.

During the transportation process of the image forming apparatus shipped from a factory, it is necessary to separate the transfer belt from a photoconductor in advance to prevent damage caused by contact between the transfer belt and the photoconductive drum.

If the separating lever of the transfer belt separating mechanism is pulled down or is in a separation releasing state, the cover cannot be closed. Therefore, it is necessary to convey the processing unit separately or insert a damage-preventing component between the transfer belt and the photoconductor during the transportation process.

BRIEF DESCRIPTION OF THE DRAWINGS

FIG. 5 (*b*) is a section view taken from the arrow direction of A-A of FIG. 5(*a*);

FIG. 6 (*b*) is a front view illustrating a cover opening and closing detection switch;

FIG. 7(*b*) is section view taken from the arrow direction of B-B of FIG. 7(*a*);

FIG. 11(*b*) is a section view taken from the arrow direction of B-B of FIG. 11(*a*).

DETAILED DESCRIPTION

An image forming apparatus according to an embodiment includes: a separating mechanism configured to move a transfer belt between a first position in which the transfer belt contacts a photoconductor to a second position in which the transfer belt does not contact the photoconductor, and a separating shaft configured to rotate from a first rotation position to a second rotation position to cause the separating mechanism to move from the first position to the second position. The image forming apparatus further includes a lever configured to be removably mounted on a first end of the separating shaft, and an accommodation section configured to accommodate the lever in a body of the image forming apparatus when the lever is removed from the separating shaft and when the separating shaft is in the second rotation position. A second end of the separating shaft interferes with the accommodation section and prevents the accommodation of the lever in the accommodation section when the lever is removed from the separating shaft and when the separating shaft is in the first rotation position.

Embodiments of the image forming apparatus are described below with reference to accompanying drawings.

Figure 1:
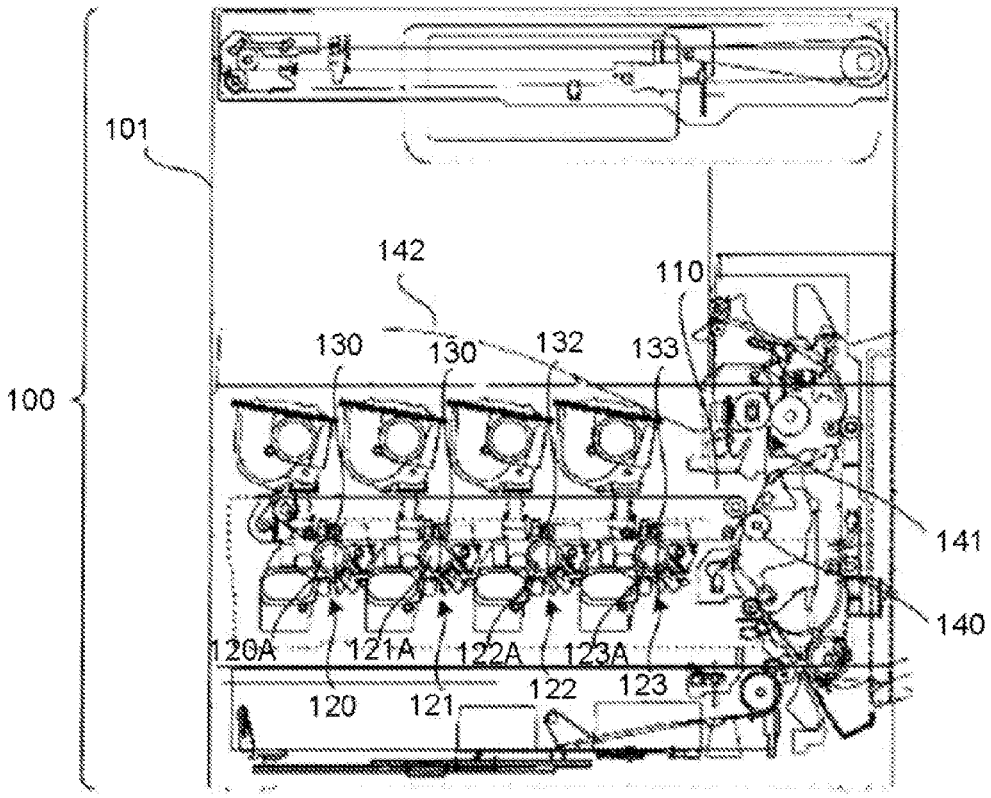
FIG. 1 is a front view illustrating an image forming apparatus according to an embodiment.
Figure 2:
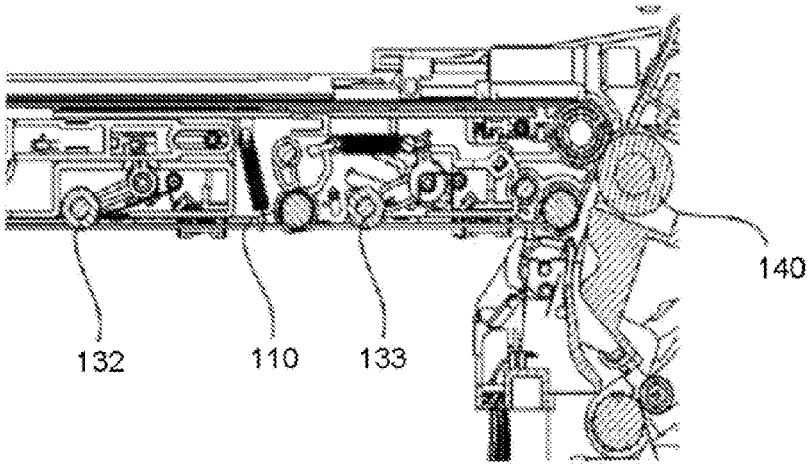
FIG. 2 is a front view detail of the image forming apparatus illustrating a transfer belt and components around the transfer belt.

FIG. 1 is a front view illustrating an image forming apparatus 100 according to an embodiment, and FIG. 2 is a front view detail of the image forming apparatus, illustrating a transfer belt 110 and components around the transfer belt.

The image forming apparatus 100 is provided with Y (Yellow), M (Magenta), C (Cyan) and K (Black) processing units 120, 121, 122 and 123 along the conveyance direction of a rotating transfer belt 110. Transfer rollers 130, 131, 132 and 133 are arranged on one side of the transfer belt 110, opposite to photoconductive drums 120A, 121A, 122A and 123A arranged in the processing units 120, 121, 122 and 123.

The transfer rollers (primary transfer rollers) 130, 131, 132 and 133 are arranged on a transfer roller holder (not shown), which is mounted on the main body 101 of the image forming apparatus. The transfer roller holder is movable in a vertical direction. When the transfer roller holder descends to a lower position, the transfer rollers 130, 131, 132 and 133 bring the transfer belt 110 into press contact with the photoconductive drums 120A, 121A, 122A and 123A. Further, when the transfer roller holder ascends to an upper position, the transfer rollers 130, 131, 132 and 133 move to positions above the transfer belt 110 to separate the transfer belt from contact with the photoconductive drums 120A, 121A, 122A and 123A. A transfer belt separating mechanism moves the transfer roller holder up and down by using a rack and pinion mechanism arranged at, for example, one end side of the conveyance direction of the transfer belt 110. The rack is positioned on the side of the transfer roller holder. The pinion is mounted on a separating shaft 30 which will be described later. The transfer roller holder ascends when the separating shaft 30 rotates in a specific direction and descends when the separating shaft 30 rotates in a direction opposite to the specific direction. The separating shaft 30 extends along the front and back direction of a paper in FIG. 1. The front and back direction is a horizontal scanning direction. The conveyance direction of the transfer belt is a vertical scanning direction.

When the transfer belt 110 is separated from the photoconductive drums 120A, 121A, 122A and 123A, the processing units 120, 121, 122 and 123 can be attached to or detached from the main body 101 of the image forming apparatus. The detaching direction is from the back side to the front side of a paper in FIG. 1. The mounting direction is an opposite direction.

When the transfer belt 110 is brought into press contact with the photoconductive drums 120A, 121A, 122A and 123A by the transfer rollers 130, 131, 132 and 133, the toner images on the photoconductive drums 120A, 121A, 122A and 123A are transferred to the transfer belt 110. The toner images on the transfer belt 110 are transferred to a paper by a secondary transfer roller 140 at a secondary transfer position. Then the toner images are heated and pressurized by a fixer 141 and fixed on the paper. Sequentially, the paper fixed with the toner images is discharged to a paper discharging section 142.

Figure 3:
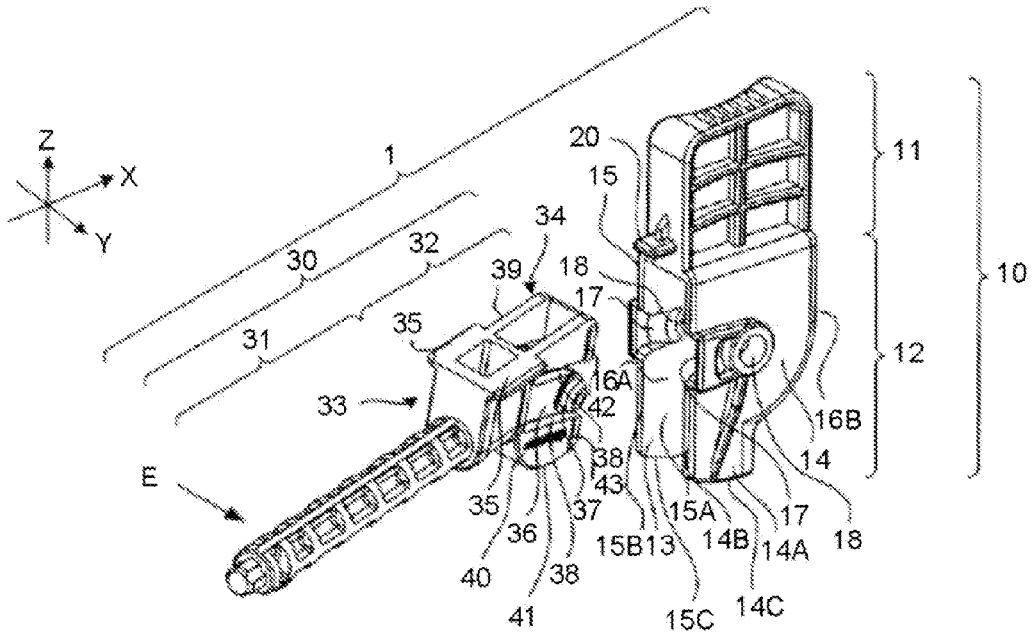
FIG. 3 is an exploded perspective view illustrating a separating lever and a separating shaft of a transfer belt separating mechanism.
Figure 3:
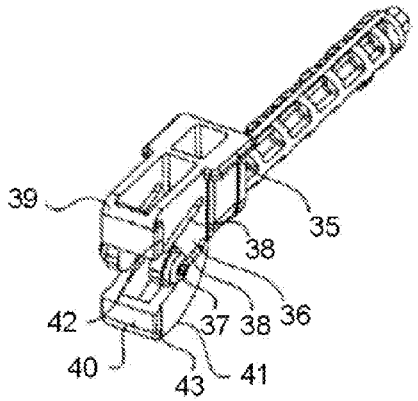

FIG. 3 is an exploded perspective view illustrating an operation section 1 of the transfer belt separating mechanism, including a separating lever 10 and the separating shaft 30. In FIG. 3, the horizontal scanning direction is set to be an X axis, the vertical scanning direction is set to be a Y axis (vertical to the X axis), and the direction vertical to the X axis and the Y axis is set to be a Z axis.

The separating shaft 30 has a shaft main body section 31 extending in the X-axis direction and a lever inserting section 32 arranged on and integrated with one end of the separating shaft main body 31. The pinion is mounted on the front end of the shaft main body 31. The lever inserting section 32 is engaged with the separating lever 10 when the separating lever 10 is inserted therein to rotationally support the separating lever 10 around the axis in the Y-axis direction. The separating shaft 30 is made from, for example, synthetic resin.

The lever inserting section 32 comprises a base portion 33 which is linearly symmetric about the X axis. The base portion 33 is arranged on the root part of the separating shaft main body 31. The base portion 33 includes a first fitting part 34. Further, a stopper portion 35 is formed above the base portion 33 along two sides of the Y-axis direction. The stopper portion positions the separating lever 10 in a pulled-down state which will be described later.

A pair of shaft supporting brackets 36, which are opposite to each other along the Y-axis direction, are arranged on the first fitting part 34 to extend in the X-axis direction from one end of the base portion 33. Shaft supporting portions 37 are formed at the front end of the pair of shaft supporting brackets 36 towards the outside of the Y-axis direction. When the shaft supporting brackets 36 are elastically deformed towards the inside of the Y-axis direction, the distance between the shafts of the pair of shaft supporting portions 37 is shortened. When the elastic deformation is released, the distance between the shafts of the pair of shaft supporting portions 37 increases.

An upper fitting body 39 and a lower fitting body 40 are respectively formed in the Z-axis direction of the pair of shaft supporting brackets 36 across a gap 38. A lower side 41 of the lower fitting body 40 is formed into a curved shape. A pair of first projections 42 and a pair of second projections 43 are formed on two side walls in the Y-axis direction of the upper fitting body 39 and the lower fitting body 40, respectively. A width W1 is a distance between the pair of first projections 42 opposed to each other and formed on the upper fitting body 39. Similarly, a width W2 is a distance between the pair of second projections 43 opposed to each other and formed on the lower fitting body 40.

The separating lever 10 is integrally formed with a gripping section 11 and a second fitting part 12, which fits around the first fitting part 34 of the lever inserting section 32. The second fitting part 12 has a pair of walls 14 and 15 formed on opposite sides of the recess 13 into which the first fitting part 34 fits. An opened end face 16A is opposite to the first fitting part 34. A closed end face 16B having a wall is positioned opposite the opened end face 16A.

The width between the internal surfaces of the pair of walls 14 and 15 of the second fitting part 12 is slightly greater than W1 so that the first fitting part 34 can be fitted almost without a gap.

Further, recessed groove parts 17 extending from the opened end face 16A towards the X-axis direction are formed on the internal surfaces of the pair of walls 14 and 15. The width between the pair of recessed groove parts 17 opposed to each other is smaller than the distance between the shafts of the shaft supporting portions 37 formed on the pair of shaft supporting brackets 36. When the pair of shaft supporting portions 37 are forcedly pressed into the separating lever 10 by pressing the shaft supporting portions 37 against the pair of recessed groove parts 17, then the pair of shaft supporting brackets 36 are elastically deformed inward, and the pair of shaft supporting portions 37 can be guided to the recessed groove parts 17.

Shaft holes 18 having a shaft center in the Y-axis direction are respectively formed on front ends of the pair of recessed groove parts 17. The pair of shaft supporting portions 37 guided to the pair of recessed groove parts 17 are inserted into the shaft holes 18. The shaft supporting portions 37 are formed with a diameter which allows for rotation of the shaft supporting portions 37 in the shaft holes 18.

Thus, the separating lever 10 is rotationally mounted on the lever inserting section 32 of the separating shaft 30 by taking the axis center in the Y-axis direction as the center. In such a mounting state, the separating lever 10 is mounted on the lever inserting section 32. Further, the separating lever 10 can rotate from a folding state, in which the gripping section 11 is directed upwards, to a lever pulled-down state in which the lever is pulled down to a near side from the folding state to be on the same line with the separating shaft 30 in the X-axis direction.

In the separating lever 10, the shaft holes 18 serving as rotation centers are arranged substantially in the center of the length direction of the pair of walls 14 and 15. When the separating lever 10 is pulled down, the pair of walls 14 and 15 sandwich the upper fitting body 39 and the lower fitting body 40 while the locking piece parts 14A and 15A formed on front ends of the pair of walls 14 and 15 sandwich two sides of the base portion 33 in the Y-axis direction. Side portions 14B and 15B of the pair of locking piece parts 14A and 15A prop against the stopper portion 35 of the base portion 33 to position the separating lever at a pulled-down position.

Figure 6:
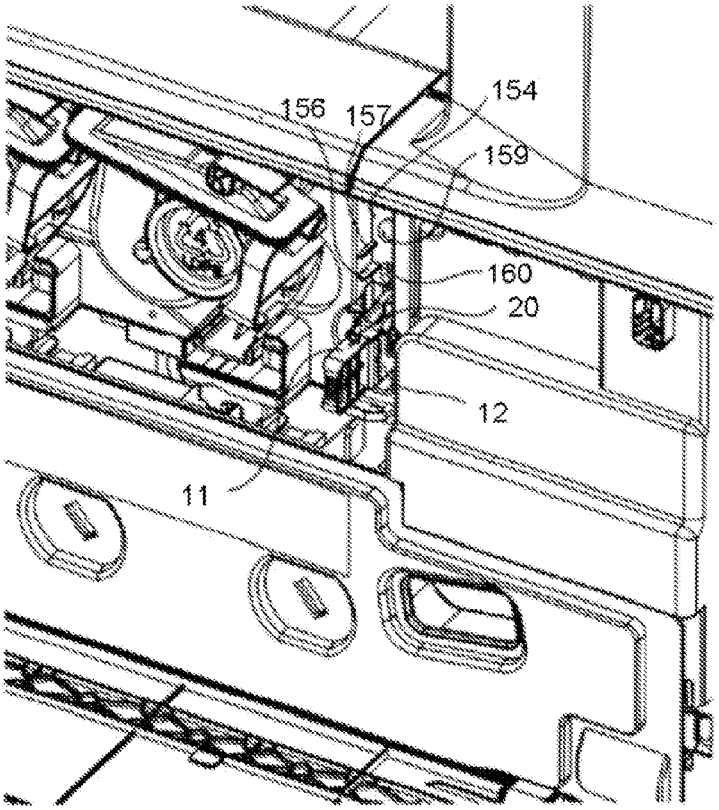
FIG. 6(*a*) is a perspective view illustrating a mounting state of the separating lever of the transfer belt separating mechanism, with the separating lever pulled down.
Figure 6:
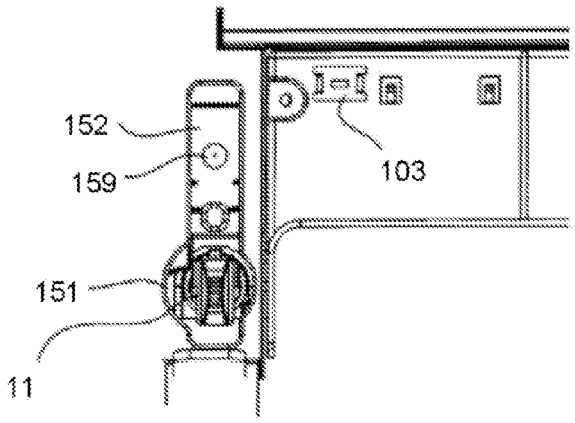
Figure 7:
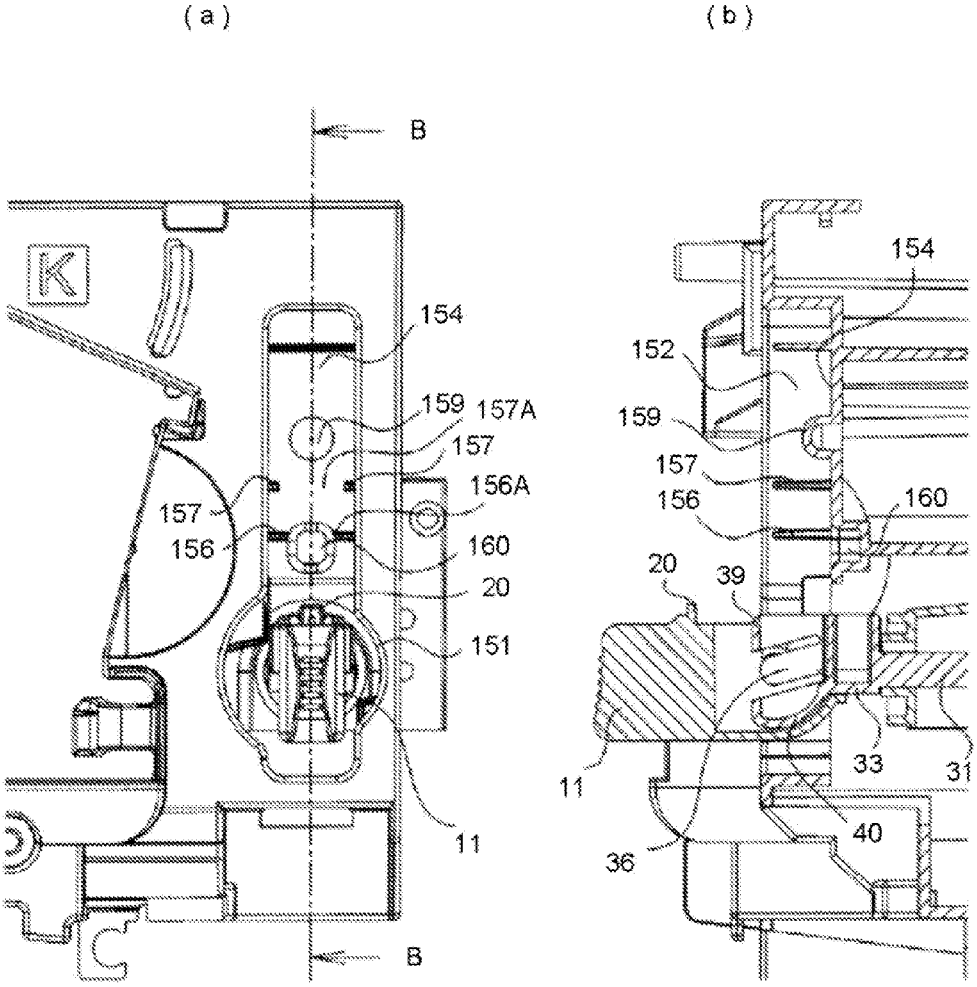
FIG. 7(*a*) is a front view of FIG. 6.

FIGS. 6 and 7 illustrate the pulled-down position of the separating lever 10. When the separating lever 10 is at the pulled-down position, the pair of walls 14 and 15 of the separating lever 10 and the pair of locking piece parts 14A and 15A sandwich the first fitting body 34 and the base portion 33 from two sides. When the gripping section 11 is manually rotated, the rotation force can be transferred to the separating shaft 30.

A thickness D1 of the gripping section 11 of the separating lever 10 in the Y-axis direction is greater than a thickness D2 of the second fitting part 12 in the Y-axis direction (D1<D2).

Figure 4:
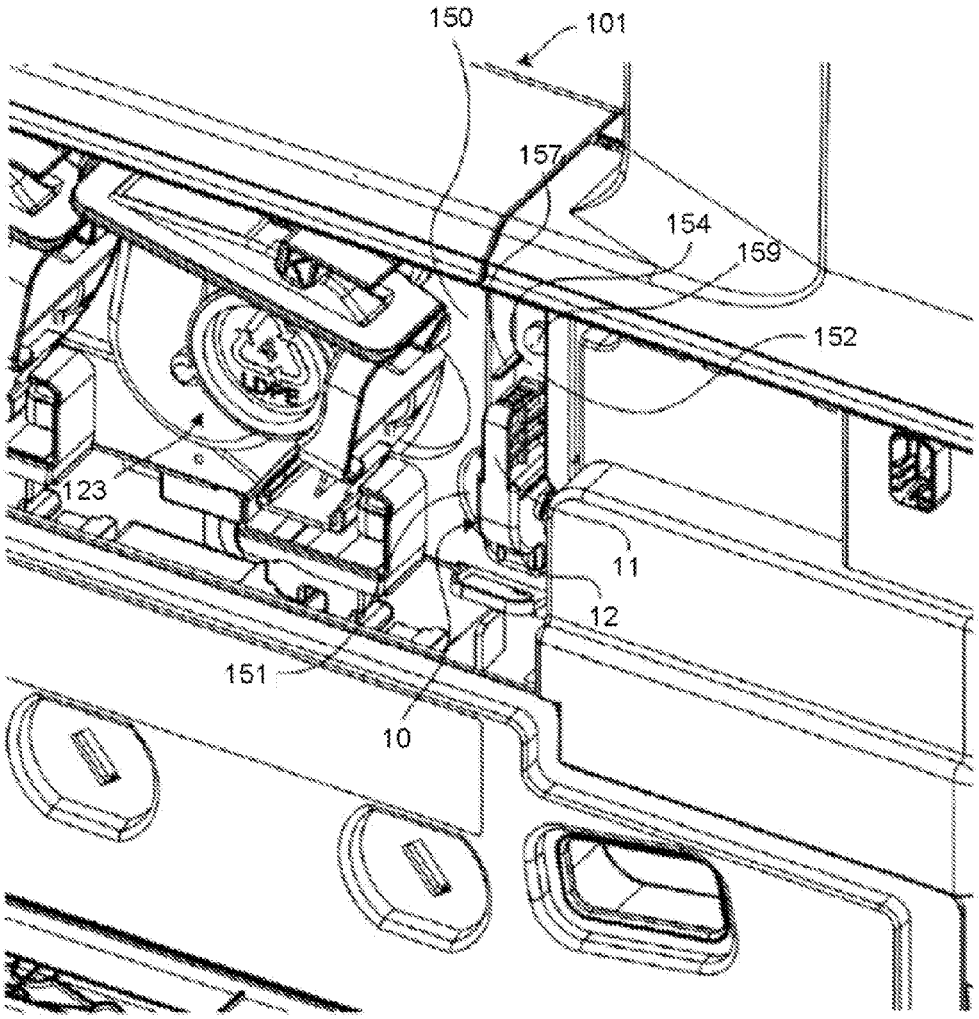
FIG. 4 is a perspective view illustrating a mounting state of the separating lever of the transfer belt separating mechanism, with a cover of the image forming apparatus closed.
Figure 5:
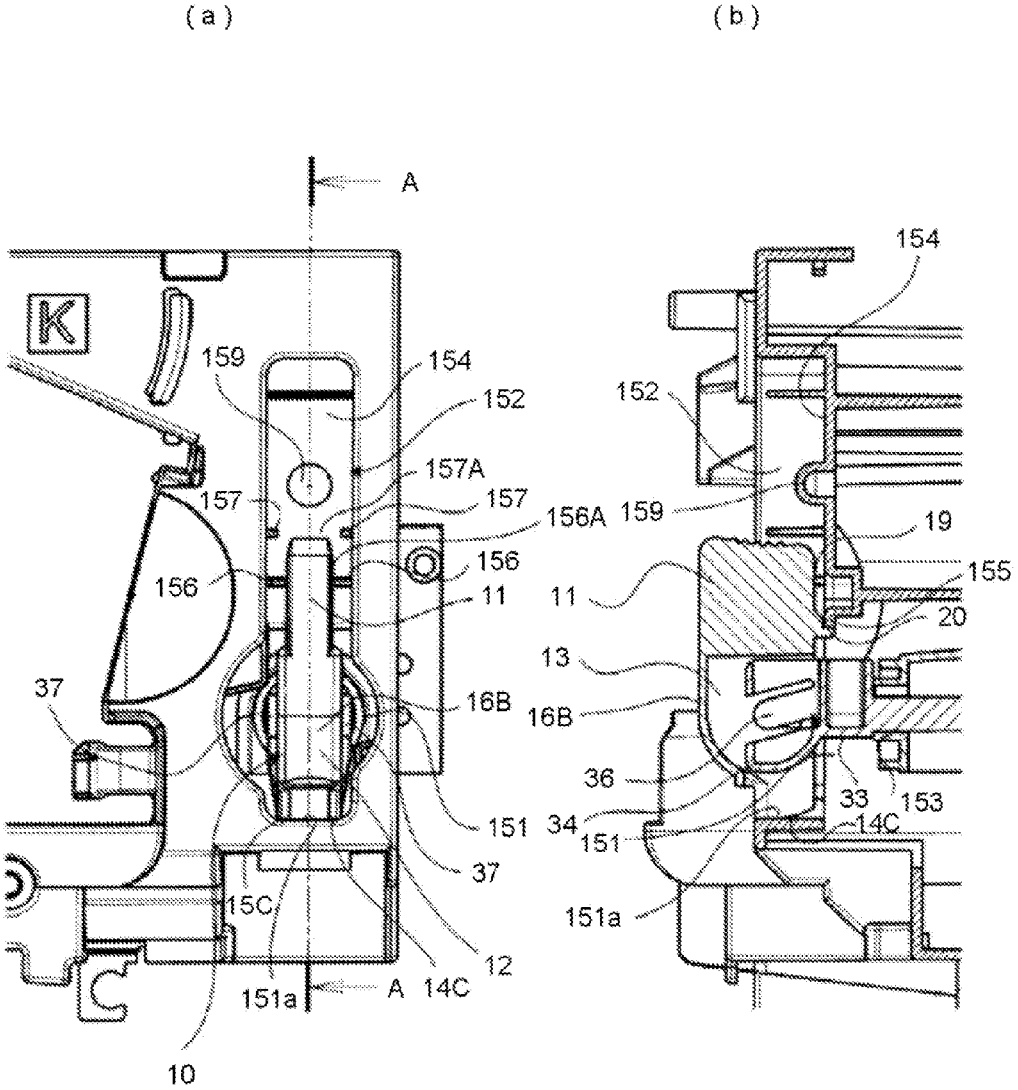
FIG. 5(*a*) is a front detail view of FIG. 4.

Next, as shown in FIG. 4 and FIG. 5, the separating shaft 30 is arranged to penetrate a front plate 150 of the main body 101 of the image forming apparatus in the X-axis direction. A first cylindrical recess 151 and a vertical rectangular second recess 152 arranged on the upper portion of the first recess 151 are formed on the front plate 150.

The base portion 33 of the separating shaft 30 is located on the front side, while the shaft main body section 31 is located at the rear side. The base portion 33 and the shaft main body section 31 are separated by an inner wall 153.

FIG. 4 and FIG. 5 illustrate a state in which the separating lever 10 connected with the separating shaft 30 is folded and positioned in the second recess 152. In this state, the transfer belt separating mechanism is in a useable state in which the transfer rollers 130-133 are in contact with the transfer belt 110, and the transfer belt 110 is in contact with the photoconductive drums 120A-123A.

The upper end of the gripping section 11 of the separating lever 10 can be pulled down from its position in the use state, as shown in FIG. 6 and FIG. 7.

Figure 8:
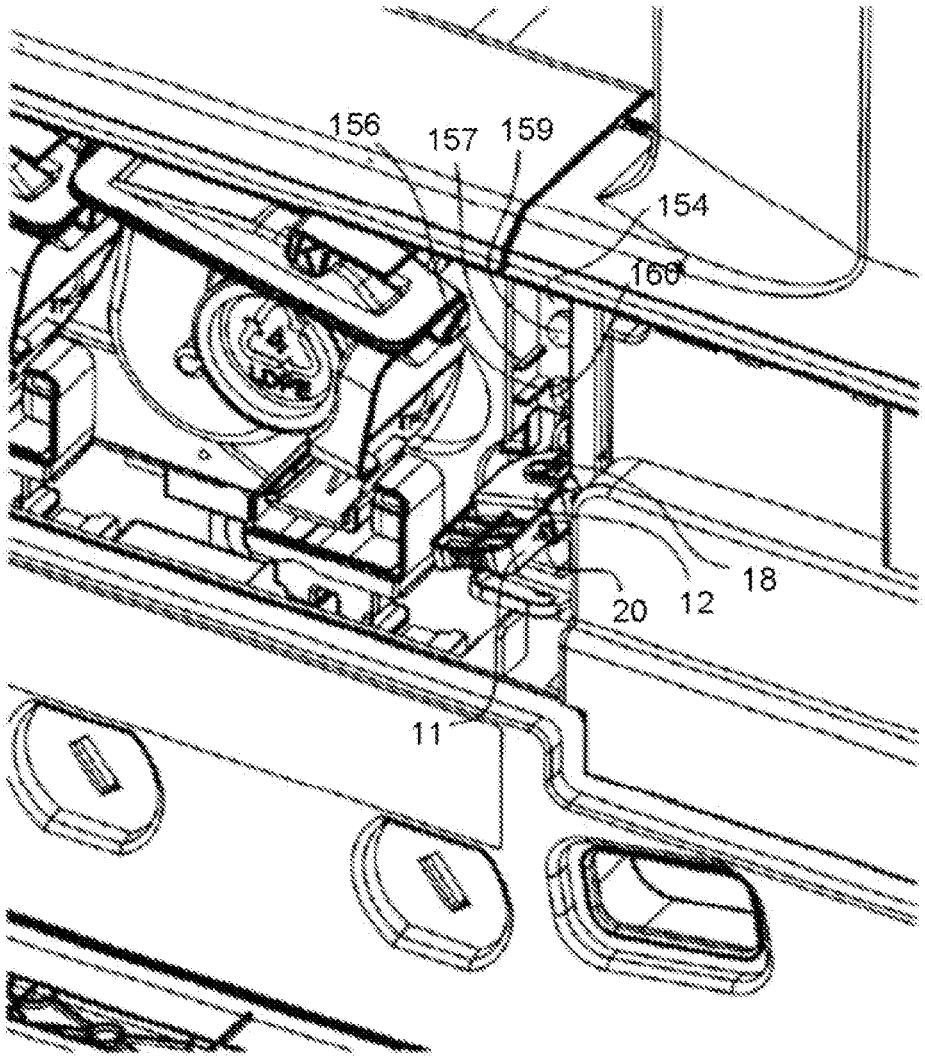
FIG. 8 is a perspective view illustrating a mounting state of the separating lever of the transfer belt separating mechanism and a separation releasing state.
Figure 9:
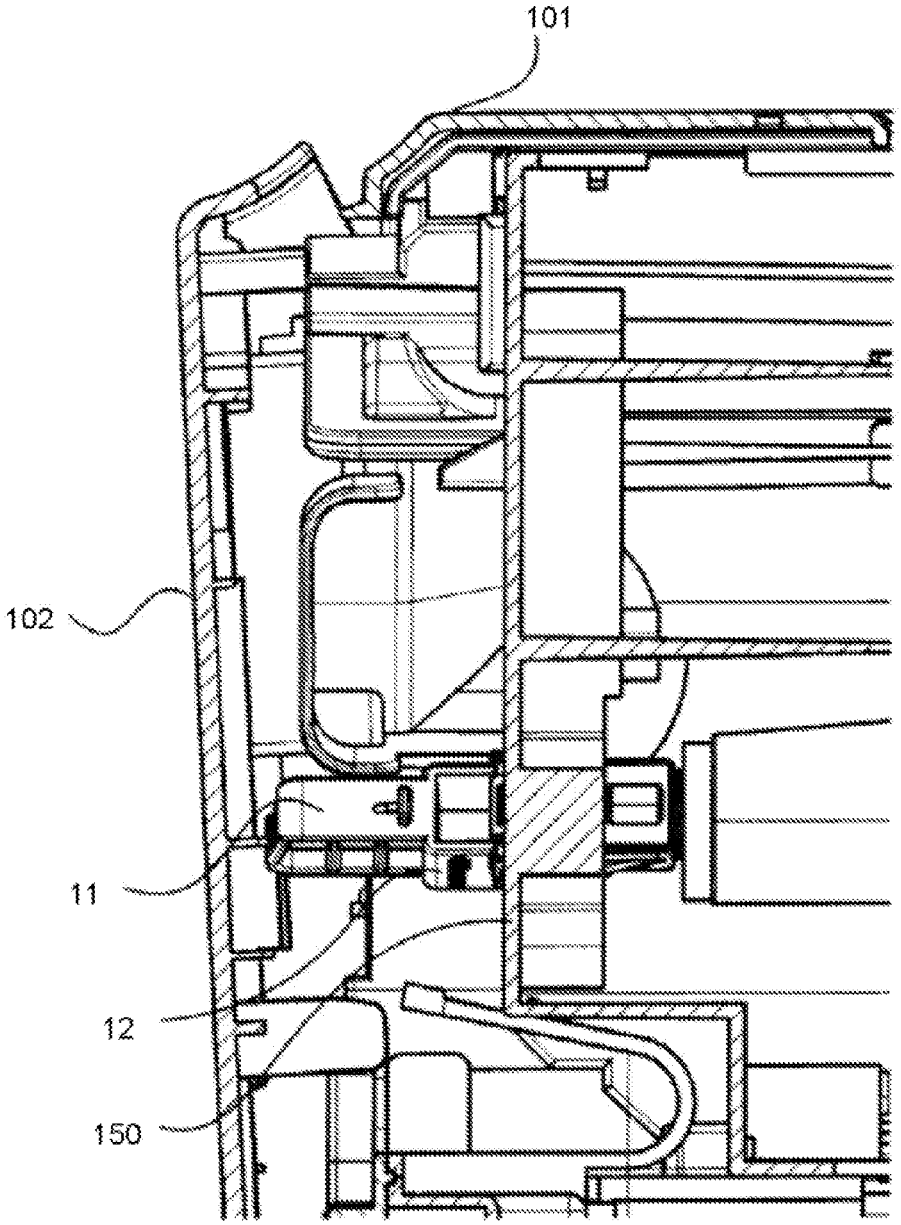
FIG. 9 is a section view illustrating a state in which a front cover is to be closed when the separating lever is in the separation releasing state shown in FIG. 8.

When pulled down, the separating lever 10 protrudes towards the nearer side. Then, as shown in FIG. 8, if the gripping section 11 is manually twisted clockwise by a specific angle smaller than 90 degrees, then the transfer belt separating mechanism lifts the transfer rollers 130-133 to separate the transfer belt 110 from the photoconductive drums 120A-123A. The separation state is maintained even if the gripping section 11 is not held by a hand. Similarly, the shaft main body section 31 can be temporarily fixed on the main body of the apparatus in the separation state and unfixed by twisting the gripping section 11 counter-clockwise.

As shown in FIG. 8, when at the separation position, the separating lever 10, cannot be folded due to the interference from the opening edge of the first recess 151. As a result, the front cover 102 cannot be closed due to interference with the separating lever 10. Consequentially, the cover opening and closing detection switch 103 (refer to FIG. 6 (*b*)) arranged on the main body 101 of the apparatus detects no closing of the cover.

Thus, the separating lever 10 is returned to the pulled-down position shown in FIG. 6 and the transfer belt separating mechanism is released from the separation state, and the separating lever 10 is folded and accommodated in the second recess 152, as shown in FIG. 4. Thereby, the front cover 102 is completely closed without interference from the separating lever 10.

A locking projection part 20 is formed on the end face 19 opposite to the inner wall 154 of the second recess 152. A locking section 155 is formed on the inner wall 154 of the second recess 152 to lock the locking projection part 20. When the separating lever 10 is accommodated in the second recess 152 and folded, the locking projection part 20 is brought into press contact with the lower side of the locking section 155 under pressure.

The other side portions 14C and 15C of the pair of locking piece parts 14A and 15A of the separating lever 10 are curved. When the separating lever 10 is folded, the other side portions 14C and 15C are brought into press contact with an inner peripheral surface 151*a* at the lower side of the first recess 151. Thus, the separating lever 10 is maintained in a locked state when positioned in the second recess 152 and folded.

A first engaging groove 156A, which is formed by a pair of first ribs 156 as a gap having a width equal to the thickness D1 of the gripping section 11 of the separating lever 10, and a second engaging groove 157A, which is formed by a pair of second ribs 156 as a gap having a width equal to the thickness D2 of the second fitting part 12, are formed in the second recess 152.

As shown in FIG. 4 and FIG. 5, when the separating lever 10, connected with the separating shaft 30, is positioned in the second recess 152, the gripping section 11 of the separating lever 10 is engaged with the first engaging groove 156A.

Figure 10:
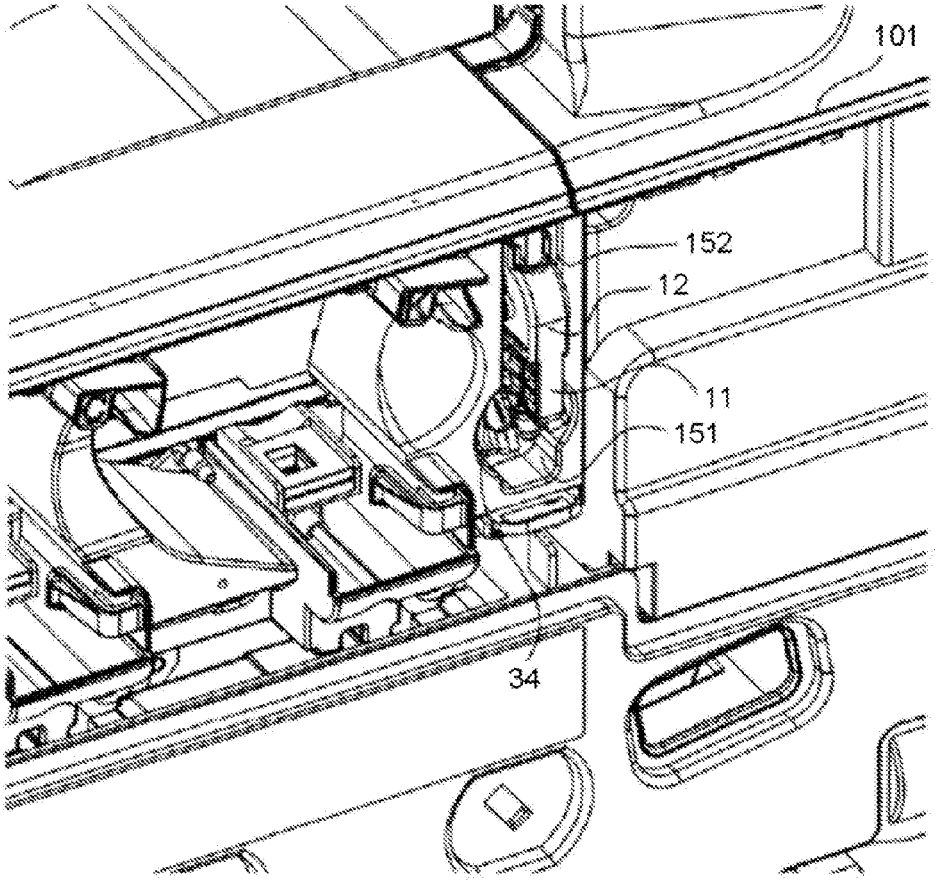
FIG. 10 is a perspective view illustrating a state in which the separating lever of the transfer belt separating mechanism shown in FIG. 1 is mounted as a single body, in a separation releasing state for transportation of the image forming apparatus.
Figure 11:
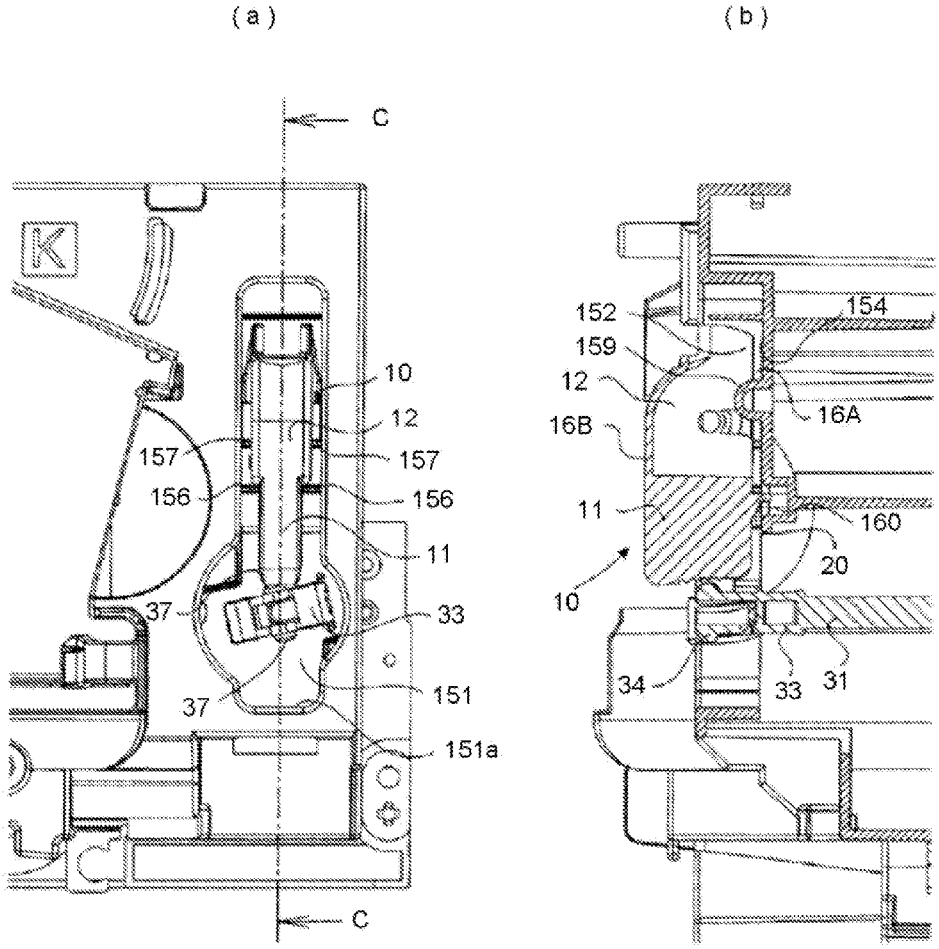
FIG. 11(*a*) is a front detail view of FIG. 10.

The separating lever 10 can be a single body, detached from the separating shaft 30, as shown in FIG. 10 and FIG. 11. In this case, the separating lever 10 is inserted into the second recess 152 upside down, that is, the gripping section 11 is at a lower position and the second fitting part 12 is at an upper position. In the second recess 152, the first engaging groove 156A is arranged on the lower portion of the second recess 152, and the second engaging groove 157A is arranged on the upper portion of the second recess 152. The gripping section 11 is inserted into the first engaging groove 156A, and the second fitting part 12 is inserted into the second engaging groove 157A.

When the image forming apparatus is shipped, the single body separating lever 10 is positioned at a regular position of the second recess 152 facing a regular direction (which will be described later), and fixed by, for example, adhesive tape. Further, the separating shaft 30 is maintained in a separation state in which the transfer rollers (130-133) are lifted with respect to the photoconductive drums, as shown in FIG. 11 (*a*). In the separation state, one side of the base portion 33 and the first fitting part 34 are slightly inclined when compared with a horizontal state. In this case, as shown in FIG. 11 (*a*) and FIG. 11 (*b*), there is a small gap between the lower end of the gripping section 11 of the separating lever 10 and one side of the first fitting part 34. Therefore, if the separating shaft 30 is in a separation releasing state, the first fitting part 34 arranged vertically. Therefore, the separating lever 10 cannot be accommodated at a specific position of the second recess 152 due to the interference from the first fitting part 34.

An interference projection section 159 protrudes forwards and is arranged on the inner wall 154 of the second recess 152. The separating lever 10 is inserted in the second recess 152 in a regular direction in which the gripping section 11 is put at the lower side and the opened end face 16A faces the inner side (a side opposite to the inner wall 154 of the second recess 152). When the interference projection section 159 is arranged at a position facing the opened end face 16A, the single body separating lever 10 can be inserted into a rear end in the second recess 152. Since locking projection part 20 protrudes on the same end face as the opened end face 16A, a hole 160 for the fitting of the locking projection part 20 is formed on the inner wall 154 of the second recess 152. Accordingly, the single body separating lever 10 can be properly positioned in the second recess 152.

The single body separating lever 10 can be properly positioned in the second recess 152 only when the separating lever 10 is inserted in the second recess 152 so that the gripping section 11 is positioned at the lower side and so that the opened end face 16A of the second fitting part 12 faces the inner side, Thus, when the image forming apparatus 110 is shipped from a factory, even if the transfer belt separating mechanism accidently sets the rotation position of the separating shaft 30 to a the separating releasing state of the transfer belt, it can be determined that the rotation position of the separating shaft 30 is not the separating position of the transfer belt. That is because the separating lever 10 cannot be properly positioned in the second recess 152 if the separating shaft 30 is positioned for the separating releasing state of the transfer belt. Therefore, transportation of the image forming apparatus 110 while the transfer belt is in contact with the photoconductive drums 12*a*-123A can be prevented.

According to the present embodiment, the image forming apparatus is shipped from a factory as a semi-finished product in which the separating lever 10 is not mounted on the separating shaft 30. When the separating shaft 30 is rotated to the separation position, the single body separating lever 10 can be mounted in the proper position. Thus, the transfer belt can still be maintained in a separated state while the cover is closed to cover the separating lever.

Thus, a buffer member need not be inserted between the photoconductive drums and the transfer belt during the transportation of the image forming apparatus, and cost can be reduced.

Further, when the image forming apparatus is delivered to a user, the operation section 1 can be assembled just by fitting the single body separating lever 10 into the separating shaft 30. Then, in the normal use, the user can separate the transfer belt from the photoconductive drum by pulling down the separating lever 10 to a nearer side and rotating the gripping section 11 to detach the processing unit. However, the cover for covering the separating lever 10 cannot be closed in this state, and so the image forming apparatus cannot operate in the separation state, which prevents the occurrence of a fault in the image forming apparatus.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a separating mechanism configured to move a transfer belt between a first position in which the transfer belt contacts a photoconductor to a second position in which the transfer belt does not contact the photoconductor;

a separating shaft configured to rotate from a first rotation position to a second rotation position to cause the separating mechanism to move from the first position to the second position;

a lever configured to be removably mounted on a first end of the separating shaft; and an accommodation section configured to accommodate the lever in a body of the image forming apparatus when the lever is removed from the separating shaft and when the separating shaft is in the second rotation position, wherein a second end of the separating shaft interferes with the accommodation section and prevents the accommodation of the lever in the accommodation section when the lever is removed from the separating shaft and when the separating shaft is in the first rotation position.

2. The image forming apparatus according to claim 1, further comprising a fitting groove section arranged in the accommodation section to specify an insertion direction for accommodation of the lever.

3. The image forming apparatus according to claim 2, further comprising:

a projection protruding in the accommodation section; and an interference section disposed on the lever, wherein the interference section interferes with the projection when the lever is inserted into the fitting groove section in a direction different from the insertion direction, and does not interfere with the projection when the lever is inserted into the fitting groove section in the insertion direction.

4. The image forming apparatus according to claim 1, wherein a cover for covering the lever can be closed when the lever is accommodated in the fitting groove section.

5. The image forming apparatus according to claim 1, wherein the lever is rotationally mounted on the first end of the separating shaft and configured to rotate relative to the separating shaft and be accommodated in the accommodation section when the separating shaft in the first rotation position.

6. The image forming apparatus according to claim 1, wherein the lever includes a gripping portion.

7. The image forming apparatus according to claim 1, wherein the accommodation section is configured to accommodate the lever when the lever is mounted to the separating shaft and when the separating shaft is in the first rotation position.

8. A transfer belt separating mechanism for separating transfer belt from a photoconductor in an image forming apparatus, comprising:

a separating shaft configured to rotate from a first rotation position to a second rotation position to move the transfer belt between a first position in which the transfer belt contacts the photoconductor to a second position in which the transfer belt does not contact the photoconductor; and a lever configured to be removably mounted on a first end of the separating shaft, wherein the lever is configured to be accommodated in an accommodation section of a body of the image forming apparatus when the lever is removed from the separating shaft and when the separating shaft is in the second rotation position, and a second end of the separating shaft interferes with the accommodation section and prevents the accommodation of the lever in the accommodation section when the lever is removed from the separating shaft and when the separating shaft is in the first rotation position.

9. The mechanism according to claim 8, further comprising an interference section disposed on the lever, wherein the interference section interferes with a projection in the accommodation section when the lever is inserted into the accommodation section in a direction different from a proper insertion direction.

10. The mechanism according to claim 9, wherein the interference section does not interfere with the projection when the lever is inserted into the accommodation section in the proper insertion direction.

11. The mechanism according to claim 8, wherein a cover for covering the lever can be closed when the lever is accommodated in the fitting groove section.

12. The mechanism according to claim 8, wherein the lever is rotationally mounted on the first end of the separating shaft and configured to rotate relative to the separating shaft and be accommodated in the accommodation section when the separating shaft in the first rotation position.

13. The mechanism according to claim 8, wherein the lever includes a gripping portion.

14. The mechanism according to claim 8, wherein the lever is configured to fold and be accommodated in the accommodating section when the lever is mounted to the separating shaft and when the separating shaft is in the first rotation position.

15. A method for separating a transfer belt from a photoconductor in an image forming apparatus, comprising:

rotating a shaft separating section from a first rotation position to a second rotation position to move the transfer belt from a first position in which the transfer belt contacts the photoconductor to a second position in which the transfer belt does not contact the photoconductor; and removing a lever from a first end of the separating shaft; and inserting the lever in an accommodation section of a body of the image forming apparatus while the lever is removed from the separating shaft and while the separating shaft is in the second rotation position, wherein the lever is prevented from being inserted in the accommodation section when the lever is removed from the separating shaft and when the separating shaft is in the first rotation position.

16. The method according to claim 15, wherein the lever is inserted in the accommodation section by being inserted into the accommodation section in the proper insertion direction.

17. The method according to claim 16, wherein an interference section on the lever interferes with a projection in the accommodation section if the lever is inserted into the accommodation section in a direction different from the proper insertion direction.

18. The method according to claim 15, further comprising:

closing a cover to covering the lever after the lever is inserted in the fitting groove section.

19. The method according to claim 15, wherein the lever is rotationally mounted on the first end of the separating shaft and configured to rotate relative to the separating shaft into and out of the accommodation section when the separating shaft in the first rotation position.

20. The method according to claim 15, further comprising:

attaching the lever to the first end of the separating shaft;

rotating the separating shaft from the second rotation position to the first rotation position to move the transfer belt from the second position to the first position; and folding the lever relative to the separating shaft and into the accommodating section.

* * * * *